US005303017A

United States Patent [19]

Smith

[11] Patent Number: 5,303,017

[45] Date of Patent: Apr. 12, 1994

[54] PRINT SKIP AVOIDANCE FOR ON-LINE COMPILING

[75] Inventor: Richard S. Smith, Rochester, N.Y.

[73] Assignee: Xerox Corporation, Stamford, Conn.

[21] Appl. No.: 57,941

[22] Filed: May 7, 1993

[51] Int. Cl.[5] ..... G03G 21/00

[52] U.S. Cl. ..... 355/318; 271/3.1; 271/186; 355/321; 355/322

[58] Field of Search ..... 355/308, 309, 318, 319, 355/321, 322, 323, 324, 320, 26, 55, 56, 24; 271/3.1, 9, 110, 114, 117, 164, 186, 303-305

[56] References Cited

U.S. PATENT DOCUMENTS

| | | | |
|---|---|---|---|
| 2,979,330 | 4/1961 | Weber | 271/36 |
| 4,566,782 | 1/1986 | Britt et al. | 355/24 X |
| 4,787,616 | 11/1988 | Sasaki et al. | 271/3.1 |
| 4,801,134 | 1/1989 | Yokoyama et al. | 271/122 |
| 4,814,822 | 3/1989 | Acquaviva et al. | 355/244 |
| 4,928,127 | 5/1990 | Stemmle | 346/160 |
| 4,928,948 | 5/1990 | Evangelista et al. | 271/110 |
| 5,008,713 | 4/1991 | Ozawa et al. | 355/319 |
| 5,028,951 | 7/1991 | Ushio et al. | 355/26 |
| 5,052,670 | 10/1991 | Makiura et al. | 271/9 |
| 5,083,761 | 1/1992 | Johdai et al. | 271/3.1 |
| 5,137,265 | 8/1992 | Sato et al. | 270/53 |

*Primary Examiner*—A. T. Grimley

*Assistant Examiner*—Thu Dang

[57] ABSTRACT

In a copier or printer producing a sequential stream of printed copy sheets with a limited space and time therebetween, and with compiling and finishing of those output sheets into plural collated finished sets on-line while subsequent sheets are being printed, an exit sheet feeder normally feeding copy sheets downstream to said compiler tray is selectably intermittently reversed to feed upstream the first copy sheet for the next set to be finished into an upstream diverter chute branching off from the regular sheet output path, assisted by a diverter gate there. The diverter chute has a reversible sheet feeder for feeding the first sheet into the diverter chute and then reversing to feed the first sheet out of the diverter chute in coordination with the passage past the diverter chute of the next subsequent copy sheet, so that both these copy sheets are fed downstream to the exit sheet feeder and into the compiler tray together, overlapped and with a substantial increase in the time between the first copy sheet and the preceding copy sheets being operated on in the compiler tray. A preset difference in relative sheet edge overlapping is provided to insure better compiler registration. With an additional entrance gate the same diverter chute may alternatively be used as an inverter.

8 Claims, 5 Drawing Sheets

PRINT SKIP AVOIDANCE FOR ON-LINE COMPILING

Cross-reference and citation is made to a copending application by the same assignee, filed Mar. 3, 1993, as U.S. application Ser. No. 08/025,475, by Barry P. Mandel, et al., entitled "Single Drive Nip Sheet Buffering System Using Independently Driven Rolls with Different Frictional Properties".

There is disclosed herein an improvement for electrostatographic or other reproducing machines sequentially printing sheets for job sets, and more particularly an improved, low cost and simple system for avoiding inter-set printing delays with on-line job set compiling or finishing, by a system for selectably delaying sheet feeding to the compiler yet maintaining positive feeding control over the sheets.

On-line set compiling and finishing is very desirable for the pre-collated sets of output copies printed and outputted sequentially by many modern high speed copiers and printers, for stacking and stapling or other finishing. However, the typical process of set collection of the printed output sheets (stacking with edge registration in a compiler tray or bin), and, especially, then stapling and ejecting that stapled set, takes a finite time period. The desired compiling and finishing time period for each collated set is often greater than the normal time period or pitch provided between the copy sheets, since the copy sheets are desirably being as rapidly sequentially printed and outputted by the copier or printer as possible. This has often necessitated a programmed "skipped pitch", or non-print cycle, in the print engine, for each set finished on-line, in many present reproduction systems. These non-print skipped pitches reduce overall productivity, especially for small job sets.

Maximizing time between incoming sheet job sets being compiled is critical to desirably providing increased available compiling and finishing time. That includes the various times required for any active edge registration feeding or jogging, active clinching, stapling, and set ejection from the compiler, and other such typical sequential functions in a compiler/stapler unit. If the finisher is an adhesive bookbinder or thermal edge binder tape type, even more finishing time may be required or desired than for normal stapling. Likewise, for a plural staple finisher, e.g., an edge stapler, or a center spline saddle stapler or stitcher, in which the set is stapled more than once with the same stapler.

Typically, there is also provided in a set compiler unit a driven flapper or other such sheet jogger for active positive registration acting on the top sheet of the stacks of sheets being compiled in the compiler tray. That presents additional problems if the subsequent sheet extends into the compiler too far before the preceding set can be removed.

One prior partial solution to these problems has been to use a higher speed final or exit transport in the downstream sheet output path, higher than the sheet path velocity of the printer/processor, so as to increase the spacing between sheets as they are fed into the compiler. However, such very high speed ejection of the sheets creates problems of its own, such as sheet stopping impact edge damage, "airplaneing" of the sheets interferring with compiler stacking, etc. Alternatively, the first sheet of the next set can be briefly temporarily slowed or stopped by a time period less than the inter-sheet pitch or gap, which is quite limited.

Another solution to this problem has been to use plural paper paths and/or plural compilers so as to divert and delay the arrival of the first sheet of a subsequent set to another path while stapling and ejecting the previous set. Plural compilers are used, for example, in the Xerox Corporation "DocuTech" printer and "5090" duplicator, as described for example in Xerox Corporation U.S. Pat. No. 4,782,363, issued Nov. 1, 1988 to James E. Britt, et al. Another patent with dual (selectably gated) sheet output paths is disclosed in U.S. Pat. No. 5,083,769, issued Jan. 28, 1992 to John J. Young, Jr. (Pitney-Bowes, Inc.). Another such dual path system is described in Canon Corp. patents cited below such as U.S. Pat. No. 5,137,265, and EP 0 346 851, where two sheets are fed through different length paths and then overlapped and commonly ejected. However, such dual paths significantly complicate the paper paths, and their drive components require additional space and cost, and have more complicated jam clearances and/or sheet path access for jam clearance.

Another reported commercial pre-finishing delay system, by Eastman Kodak Co., in its EKTAPRINT 300 and possibly other copier products is schematically represented in FIG. 7 here, labeled "prior art." As understood, it uses a large elastomeric cylindrical feed roller, and a hemi-cylindrical surrounding baffle, upstream of a sheet output gate. At least two sheets are overlapped while the first sheet is temporarily held by this gate, and then the two sheets are commonly ejected. However, in that system, there is reportedly an undesirable requirement to slide the second sheet under the first for a long distance within the confined arcuate baffle while the first is held stationary in the same thin arcuate space. Also, as understood, there is no positive drive of the first (outside) sheet during the initial feeding out of both sheets to the compiler. This runs contrary to a basic tenant of sheet handling to maintain all sheets in a positive feeding nip at all times, rather than depend on low friction between sheets to slide past one another, or high friction between sheets to overcome baffle friction and other resistances, especially with arcuate sheet paths, and especially where pushing, rather than pulling, a flimsy sheet.

Another patent noted was Océ Nederland B.V. U.S. Pat. No. 5,012,296, issued Apr. 30, 1991 to Jay Dinnissen, et al.. This patent shows an inverter in the duplex path and also in the document handler path.

Pending commonly assigned Xerox Corporation application Ser. No. 07/907,273, filed Jul. 1, 1992 by Thomas Acquaviva entitled "Document Handling System Having a Shunt Path" provides a long and "U" shaped shunt loop path, and for a different function; for original documents to be held in that path for copying a set of documents out of order.

Another type of system may exist in which all the output copy sheets are slowed down before their output in a shingling device or system which runs at a slower speed than the printer processing speed so as to cause the copy sheets to partially overlap or shingle upon one another. However, this then would appear to require a more complex and difficult arrangement to separate, compile and stack the completed job sets, and make it even more difficult to obtain a clear space in distance and time between the last sheet of one set to be compiled, stapled and ejected and the next sheet of the next set to be compiled.

Prior art copier or printer output sheet inverters are also variously shown in the above and various other patents. These normally operate by feeding one end of a sheet into an inverter chute from one (upstream) sheet path direction and feeding the other end of the sheet out of the inverter in the other (downstream) path direction, so as to turn the sheet over, end for end.

Prior art on cover or other sheet inserters is distinguishable, as not presenting these same problems. There the insert sheets are already pre-printed and are coming from a separate supply of these extra sheets, and are merely being merged with the printer or copier output sheets. Thus, these extra inserted sheets do not require any interference with or delay in the continuity of the printing process.

A specific feature of the specific embodiments disclosed herein is to provide in a reproduction apparatus for producing a sequential stream of precollated outputted printed copy sheets into a sheet output path with a limited space and time therebetween, and for compiling and finishing said stream of output sheets into plural collated finished sets on line as subsequent said copy sheets are being printed and outputted by said sheet output path of said reproduction apparatus, by outputting said stream of copy sheets in said sheet output path downstream into a compiler tray for repeatedly sequentially stacking said copy sheets into collated printed sets, the improvement comprising: a reversible exit sheet feeder upstream of said compiler tray for normally feeding copy sheets downstream to said compiler tray; said reversible exit sheet feeder being selectably intermittently reversed to reverse the feeding of a first copy sheet therein upstream in coordination with the operation of said compiler tray on preceding copy sheets; a sheet diverter chute path upstream of said exit sheet feeder, branching off from said sheet output path; a diverter gate actuated to divert said first copy sheet out of said sheet output path into said diverter chute when that first copy sheet is reverse fed upstream by said reversible exit sheet feeder; said diverter chute having another reversible sheet feeder therein for first feeding said first sheet into said diverter chute and then reversing to feed said first sheet out of said diverter chute in coordination with the passage past said diverter chute of a next subsequent second copy sheet, so that both said first and second copy sheets are fed downstream to said exit sheet feeder together; said exit sheet feeder then being operated to feed both said first and second sheets together downstream to said compiler tray, with a substantial increase in said time between said first copy sheet and said preceding copy sheets being operated on in said compiler tray.

Further specific features disclosed by the system disclosed herein, individually or in combination, include those wherein said output path is substantially planar and said diverter gate is maintained out of said planar sheet output path whenever a sheet is moving downstream in said output path past said diverter gate, and wherein said diverter gate is actuated into said output path for said deflecting of said first sheet into said diverter chute in the reverse upstream movement of said first sheet, and not for said second sheet, and/or wherein said first sheet is underlying said second sheet as they are so fed to said compiler tray, and wherein said sheet feeder in said diverter chute is operated so that said first sheet being fed underlying into said compiler tray leads said overlying second sheet at the edges of said first and second sheets which are being edge registered in said compiler tray.

The system disclosed in these exemplary embodiments below overcomes the above and other problems in an otherwise desirably normal sheet output system by delaying only the first (single) sheet following the last sheet of the previous job set to be compiled. This is done in all these examples by stopping the paper path output feeder for only that one sheet, with that first sheet in the nip, reversing that output feeder to temporarily drive that first sheet backwards (upstream) into a buffer path or chute (which is effectively a side path branching off from the normal or main output path). A special deflector gate guides this reversed movement sheet edge into that buffer chute entrance. Meanwhile, the subsequent, immediately following, (second) sheet is feeding out normally, passing over this buffer chute entrance. At that point, the first sheet is now fed forward by a sheet feeder in the buffer chute to feed out of the buffer chute back into the main sheet output path, where the first sheet is now shingled under the second sheet, and both overlapping sheets are now driven forward, but with one sheet lagging slightly behind the other in the output path. Both sheets are then fed into the (now emptied) compiler tray by the normal operation of the output feeder to start the next set to be compiled and finished. Meanwhile, this operation has provided a substantial increase in the distance and time between these two sheets and the immediately prior last sheet of the previous set.

The present invention is applicable to almost any on-line compiler/finisher system, not limited to those illustrated. By way of further background, some examples of compiler trays with joggers or other set registration systems and staplers or stitchers (generally referred to herein as staplers), include Xerox Corporation U.S. Pat. Nos. 4,417,801 and 4,541,626. The compiler unit herein could alternatively be, for example, similar to that disclosed and described in allowable Xerox Corporation Application Ser. No. 07/888,091, filed May 26, 1992, by Barry P. Mandel, et al.; or that of his issued U.S. Pat. No. 5,098,074. Other examples of compiler tray registration sheet feeder/joggers are in (and cited in) Xerox Corporation U.S. Pat. No. 5,120,047. As noted there, and as otherwise well known, the compiler tray may be one of a plural array of compiler trays or bins.

It will also be appreciated that compilers and finishers may be internal or external, such as in modular units operatively connecting with the reproduction apparatus, as disclosed in the above and other patents and products.

The terms "copy sheet", "copy", "output", or "output sheets" herein are still generally used to refer to the paper or other such typical flimsy physical image substrate sheets outputted by a reproduction apparatus, such as a xerographic copier or printer, and whether imaged or printed on one or both sides. These output sheets are now often, of course, not literal "copies" in the old-fashioned sense, since the term now may also encompass computer-generated graphic images (as well as various text) for which there is not necessarily a physical "original" being copied optically or electronically scanned, although that is also encompassed by the term "copy" or "output" sheets here. Likewise, the term "printing" here does not imply old-fashioned uncollated letterpress printing. A "job" is a set of related sheets, usually a collated copy set copied from a set of original document sheets or electronic page images from a particular user or otherwise related.

This system will work with N-1 or 1-N output page sequence printers or copiers, and/or faceup or facedown output for compiling, or any of these possible combinations. For "1 to N" output the two sheets acted on by this system would be sheets 1 and 2 of the next collated set. For "N to 1" output, the two sheets to be acted on for delay would be sheets N and N minus 1 of the next collated set. The "first" and "second" sheets discussed herein can be either. The shingling of these two sheets will not affect proper registration in any of those modes, if adjusted as discussed above.

The disclosed apparatus may be readily operated and controlled in a conventional manner with conventional control systems. Some additional examples of various prior art copiers with control systems therefor, including sheet detecting switches, sensors, etc., are disclosed in U.S. Pat. Nos.: 4,054,380; 4,062,061; 4,076,408; 4,078,787; 4,099,860; 4,125,325; 4,132,401; 4,144,550; 4,158,500; 4,176,945; 4,179,215; 4,229,101; 4,278,344; 4,284,270, and 4,475,156. It is well known in general and preferable to program and execute such control functions and logic with conventional software instructions for conventional microprocessors. This is taught by the above and other patents and various commercial copiers. Such software may of course vary depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hardwired logic or switching systems. As shown in the above-cited and other art, the control of exemplary sheet handling systems may be accomplished by conventionally actuating them by signals from the copier or printer controller directly or indirectly in response to simple programmed commands and from selected actuation or non-actuation of conventional copier switch inputs by the copier operator and sheet position sensors in the sheet paths. Conventional sheet path sensors and/or switches, connected to the controller may be utilized for sensing and timing the positions of the sheets, as is well known in the art, and taught in the above and other patents and products. The resultant controller signals may conventionally actuate various conventional electrical solenoid or cam-controlled sheet deflector fingers, motors or clutches in the selected steps or sequences, as programmed. [The Federal Circuit has held that if a microprocessor is indicated in the specification, one skilled in the art would know how to perform the necessary steps or desired functions described in the specification, and need not necessary disclose actual software or "firmware" for 35 USC §112 disclosure support. In re *Hayes Microcomputer Products Inc. Patent Litigation* (CA FC Dec. 23, 1992).]

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of these embodiments thereof, including the drawing figures (approximately to scale) wherein:

Shown in FIGS. 1 and 3–6 is one example of an on-line print stream intermittent sheet delay system, for compiling and stapling of prior copy sheet sets from a printer or copier 10 without interrupting or delaying any subsequent copy sheet printing. Only the final sheet output path 12 (comprising the subject system) and associated components need be shown here, as in FIGS. 3–6, since other components can all be conventional and unmodified. This special processing need be done here only for the first two sheets of the next set to be compiled, and only the first sheet is handled abnormally in this system.

Figure 7:
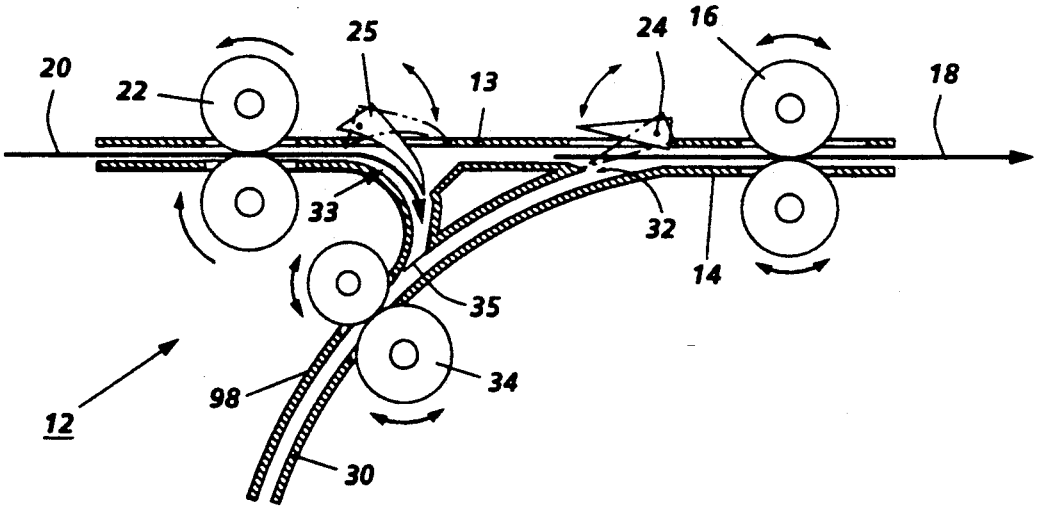
FIG. 7 illustrates an alternative embodiment in which the first sheet delay diverter chute is also alternatively used as an output sheets inverter, with a second gate.

Here a desirably generally planar or linear printer or copier 10 output path 12 is defined by conventional upper and lower planar baffles 13 and 14. This planar sheet output path 12 has reversible exit feed rolls 16 at the downstream end, just prior to the compiler/stapler module or unit 90. Thus, here these exit rolls 16 may also be the entrance feed rollers to the compiler unit 90. [Although exit rollers 16 are shown, it will be appreciated that a feed belt or other sheet feeder could be utilized.] Upstream of these exit rollers 16 in the output path 12 are upstream feed rollers 22. (These may be positioned upstream by approximately slightly less than the feeding dimension of a conventional feeding sheet 20, e.g., about 20 cm or less in an edgewise or long-edge-first print system). Between the exit rollers 16 nip and the nip of the upstream feed rollers 22 is a diverter gate 24 for diverting a sheet being fed upstream (not downstream) by rollers 16 (when they are reversed) into the entrance 32 of sheet diversion chute 30 branching off at an angle there from the main output path 12. Within the diverter chute 30 are reversible feed rollers 34 for positively nipping a sheet thereon at all times. Note that this chute 30 here is not a sheet inverter and does not invert sheets. However, as discussed below, re FIG. 7, this chute could alternatively or additionally be used for output sheet inversion if provided with an appropriate downstream entrance and gate.

An existing controller 100 of the printer or copier reproduction apparatus 10 may control all the herein indicated operating steps, as discussed above. Examples of conventional sheet edge detection sensors in the sheet paths are conventionally schematically represented in FIG. 1 and shown connected to controller 100.

The operation of this disclosed exemplary system is further successively sequentially illustrated in FIGS. 3 to 6. For purpose of discussion here, and noted above, a "first" sheet 18 and "second" sheet 20 will be referenced to. The "first" sheet 18 is the sheet immediately following the immediately prior "last" sheet of the previously collated job set in compiler tray 92. The "second" sheet is the one immediately following the "first" sheet. They are being normally printed and normally fed out in a normal, evenly spaced, sequence.

Figure 1:
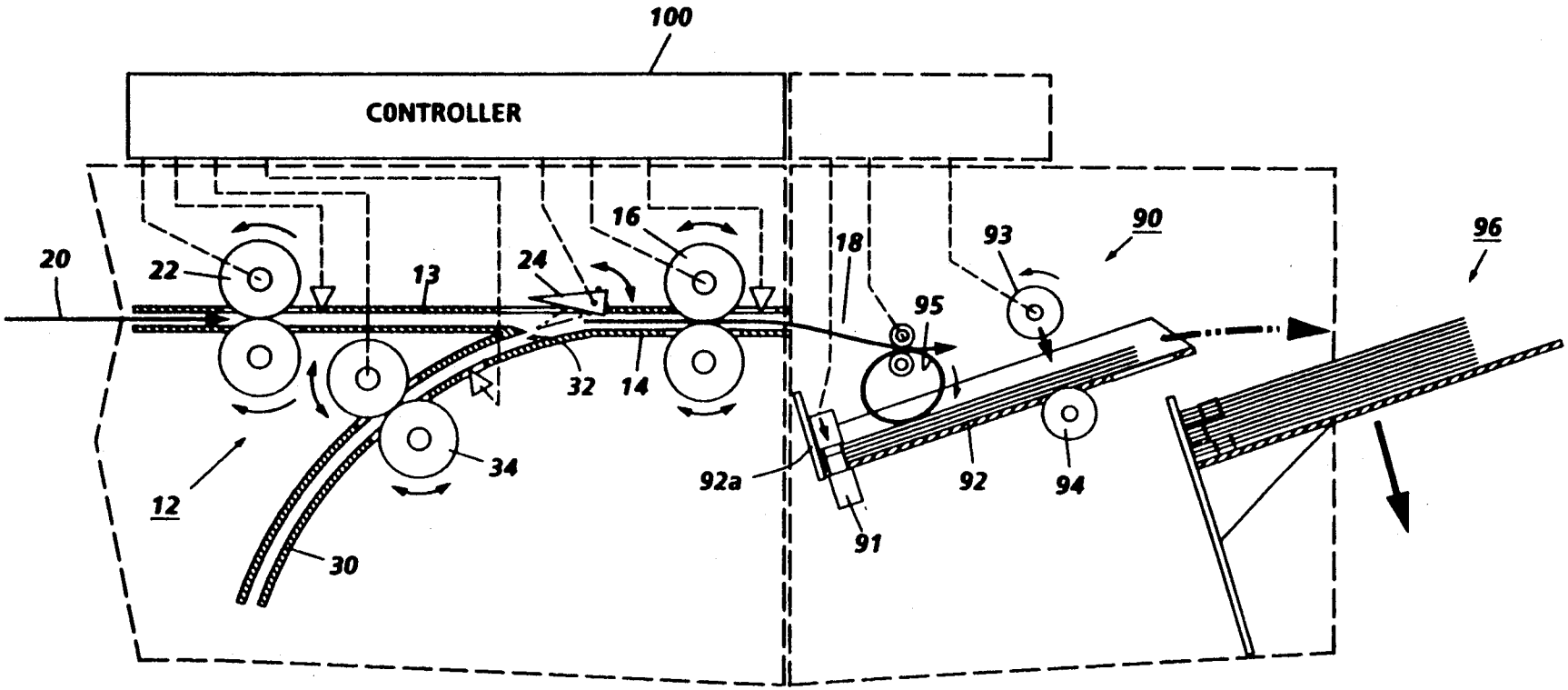
FIG. 1 is a schematic side view of one embodiment of the subject printer delay avoidance system for compiling and finishing, shown with an exemplary compiler unit therefor.
Figure 3:
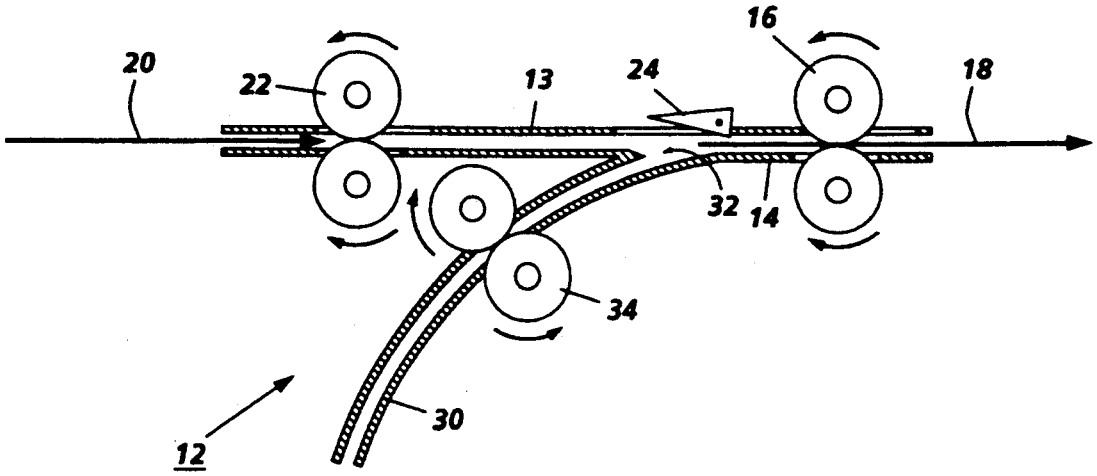
FIGS. 3–6 are identical side views of the key portions of the system of FIG. 1, respectively showing sequential operating steps thereof.

Referring to FIGS. 3–6, these Figures sequentially illustrate the steps of operation of this exemplary output system 12 of FIG. 1. FIG. 3 shows (as in FIG. 1), the normal sheet feeding operation with the normal sheet printing spacing initially between the sheets 18 and 20. The first sheet 18 is in, and partially extending out of, the normal sheet exit (and compiler entrance) rollers 16. This normal feeding continues until the trail edge of sheet 18 has passed the diverter chute 30 entrance 32 (the buffer path intersection with the main output path). This event timing can readily be predicted by controller 100 from the illustrated sheet edge detector sensors in the sheet path even for sheet size variations. Note that stopping the output rollers 16 with a sheet hanging out too far downstream may be undesirable, if the sheet could be extending sufficiently into the compiler tray to be engaged by an active compiler/jogger, or otherwise create problems.

Figure 4:
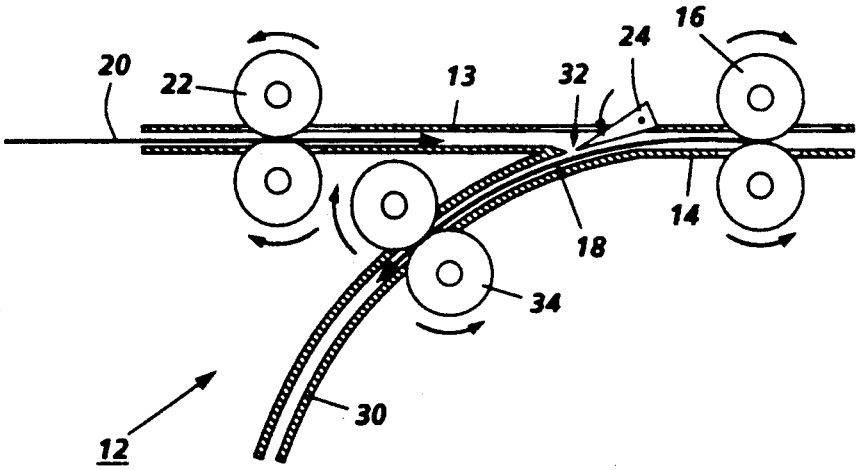

Now referring to FIG. 4, at this point the exit rollers 16 are shown reversed, so that the first sheet 18 is driven rapidly upstream. Also, the deflector gate 24 is pivoted down into the sheet path, to guide first sheet 18 into chute 30 before the second sheet 20 reaches that gate 24. However, these two operations are undertaken only if the sheet 18 is the first sheet following a prior set being fed to the compiler to be compiled, i.e., this operation is coordinated by the controller 100 with the compiler operation and the document set count, already in the controller 100. The gate 24 can lift back up as soon as the sheet 18 is in nip 34.

Figure 5:
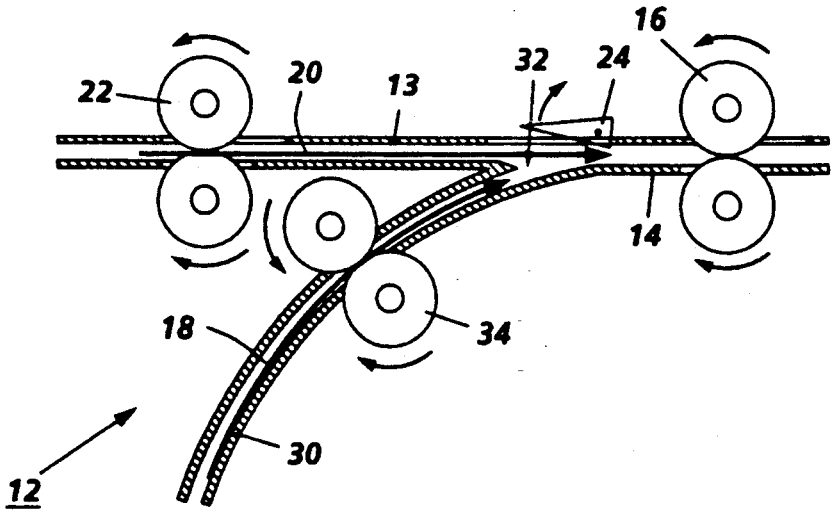

FIG. 5 shows that the gate 24 has now lifted back up out of the way of the following oncoming second sheet 20. Sheet 20 is shown passing over sheet 18 which is now inside chute 30. Thus, sheet 20 moves normally linearly and unobstructially towards exit rollers 16. Also in FIG. 5, all the rollers 22, 34, and 16 are now driving forward (downstream). The first sheet 18 is being driven out of chute 30 to merge in the main output path with (under) sheet 20. Both sheets are being positively driven, separately, (by rollers 22, 34) but they are moving together in the main sheet exit path to the nip exit rollers 16. I.e., one sheet does not need to try to slide relative to the other, unlike prior art systems noted herein.

Figure 6:
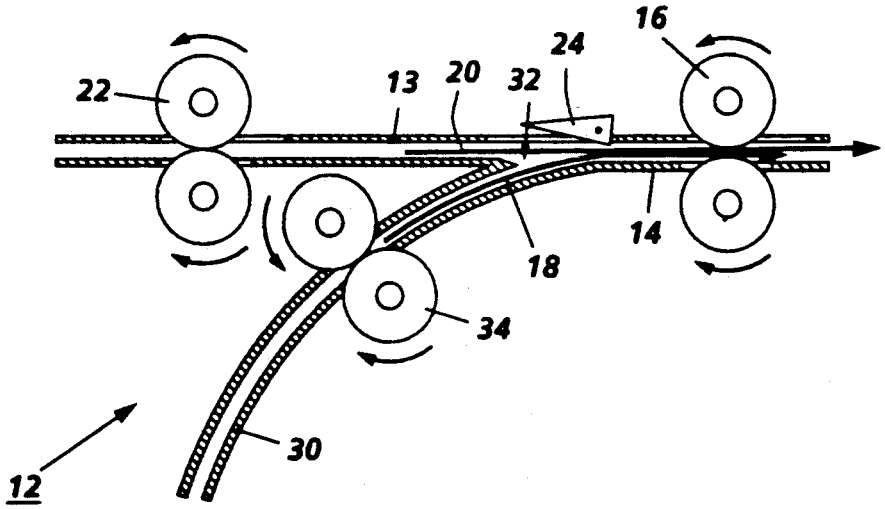

In FIG. 6, both sheets 18 and 20 have reached, and been fed together forward, by rollers 16. The two sheets are overlapping, with the lead edge of underlying sheet 18 slightly behind the lead edge of overlying sheet 20, in this example.

To recapitulate, the system disclosed in this embodiment is to delay only the first (single) sheet 18 immediately following the last sheet of the previous set, by stopping the paper output path output rollers 16, for that one sheet, reversing those output rollers 16 with that first sheet 18 in the nip to temporarily drive that first sheet 18 backwards into a buffer path or chute 30 branching off under [or above] the main output path 12. A deflector gate 24 then guides this sheet 18 rear edge into that buffer chute 30 entrance 32 in this reverse feed movement. Meanwhile, the subsequent immediately following (second) sheet 20 is feeding out normally, passing over this buffer chute entrance 32. At that point, the first sheet 18 is now fed forward by feed rollers 34 in the buffer chute 30 to feed out of the buffer chute 30 back into the main sheet path 12, where that first sheet 18 is now shingled under the second sheet 20, and both sheets 18 and 20 are now driven forward, overlapping, but preferably with one sheet lead edge following slightly behind the other in the output path. Both sheets are then fed into the compiler tray 92 (or 82) by the output rollers 16 to start the next set to be compiled and finished there. Meanwhile, this operation has provided a substantial increase in the distance and time between these two sheets and the immediately prior last sheet of the previous set.

In the schematic example here in FIG. 1 of a known "uphill" stacking sheet job set compiling and (optional) stapling (91) and ejecting system 90, the sequentially incoming undelayed sheets here are fed directly by rollers 16 into the compiler/stapler unit 90, as shown by the sheet movement arrow. Sheets may be compiled in compiler tray 92 by dropping and being fed and registered against the stacking wall **92*a* of the compiling tray 92. During this set compiling and registration, a compiled set discharge member 93, comprising a set ejector drive roller, may be in a disengaged up position, as shown, not in contact with any of the sheets in the compiling tray 92. Once the incoming sheet has been discharged from the sheet entrance rolls and drops onto compiler tray 92, the top surface of the incoming sheet is then also contacted by a an active registration assistance system, here comprising a rotatably driven frictional flexible compiler registration jogger such as belt 95, causing the top sheet to be driven until it is fully registered against the wall 92*a* of the tray 92. This type of compressible open or "floppy belt" jogger for compiler assistance is further disclosed in Canon U.S. Pat. No. 4,883,265 (issued Nov. 28, 1989 to N. Iida, et al.); U.S. Pat. No. 5,137,265, and EP 0 346 851. Each subsequent sheet is compiled on top of the prior sheets on tray 92 in this manner. A conventional lateral registration tamper can also be provided, as in the cited or other art. That is, once each sheet is discharged and registered with the help of the rotation of the frictional floppy belts 95 against the topmost surface of the sheet in the compiling tray 92, a lateral tamper can engage to shift each sheet to a lateral registration edge of the tray 92. Because the floppy registration belts 95 are so flexible, and are held only at their top, they are easily deformed in the lateral direction. Alternatively, it is also known for an active top sheet registration system such as 95 or 86** to be at an angle, feeding incoming top sheets towards a registration corner, for positive 2-axis registration with one sheet registration feeder.

Figure 2:
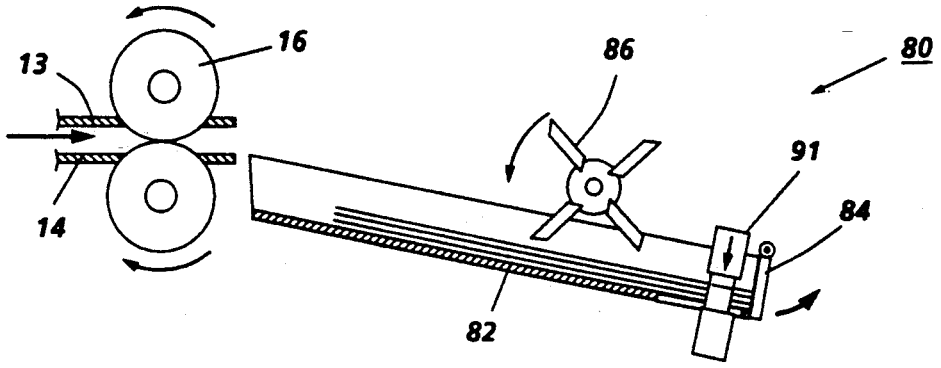
FIG. 2 is a partial side view showing a different (alternative) compiler unit embodiment, with "downhill" stacking rather than "uphill" stacking, operative with the other elements of FIG. 1 with the minor distinctions taught herein.

In the exemplary FIG. 2 compiler unit 80, stacking registration is assisted by another known type of rotatably driven active top compiler, here an elastomeric frictional fingers flapper/jogger 86, or the like. It is also acting directly on the top sheet, and indirectly on underlying sheets by inter-sheet friction. That type of compiler assistance 86 could alternatively be used in the system 90 of FIG. 1.

Once a fully compiled set is accumulated and stapled with registration alignment in compiler tray 92, a conventional powered stapler such as 91 may be actuated to fasten the set together. Then the set discharging member 93 is brought down to form a set ejecting nip with mating idler rollers 94 (shown near the outer end of compiler tray 92), to eject that finished set into a conventional (but square stacking) elevator/stacker unit 96 to squarely stack that set on top of the previous finished sets, as shown in FIG. 1. [This could alternatively be a designated user's bin of a plural bin shared user printer "mailboxing" unit.]

If no compiling or stapling is desired, ejector rollers 93 are held closed against rollers 94 to feed the output sheets directly on through the compiler unit 90 to stacker 96.

Note that during this compiling and finishing operation, the sheets may partially extend and hang out into an adjacent bin, or onto the top of the stack in stacker 96, saving overall compiler tray width. That is, the compiler tray 92 may be only a partial sheet supporting shelf for most sizes of sheets, as in the above-cited Mandel U.S. Pat. No. 5,098,074 or Canon U.S. Pat. No. 5,137,265; and/or Xerox Corporation U.S. Pat. No. 5,201,517, by Denis Stemmle, issued Apr. 13, 1993, entitled "Orbitting Nip Plural Mode Sheet Output With Faceup or Facedown Stacking". The latter is also an example of a compiler/stapler providing selectable faceup or facedown stacking with an integral inversion system.

If the compiler is an "uphill stacking" type such as 90 of FIG. 1, in which the incoming sheets slide back downstream in the compiler tray 92 to rear edge **92*a* register the previously trailing edges of the sheets, then it is preferable for the second (overlying) sheet 20 lead edge to lead slightly the first (underlying) sheet 18 of the sheet pair being ejected, for better registration as the active compiler 95 acts on the top sheet 20. If, however, as in FIG. 2, the compiler unit 80 with tray 82 is of the type which slopes downwardly away to provide "downhill" downstream stacking, in which the lead edges of the entering sheets register or align in the process direction against an outer registration edge (here a pivotal set ejection gate 84), then, in that type of system 80, preferably the second (top) sheet 20 lead edge slightly lags behind the first (bottom) sheet 18 of the incoming pair, for better active registration in that type of compiler. That is, insuring the positive compiler edge registration of the underlying sheet can be provided in "downhill" compiling (as in FIG. 2) if the underlying first sheet 18 is fed out of the buffer chute or side track 30 faster than the (processor) speed of the second sheet 20, so that by the time both lead edges reach the final exit rollers 16, the first (underlying) sheet 18 lead edge slightly leads the overlapping sheet, instead of lagging, as shown in system 90 of FIG. 1 for "uphill" compiling. In this way, in either type of compiler, the top-of-stack jogger acting on the topmost (second) sheet 20 as it comes into the compiler tray should also register the underlying first sheet 18**.

To express it another way, in "uphill" stacking systems, the compiler registration edge is acting on what is the trailing edge of the ejecting sheets. In "downhill" stacking systems, the registration edge is the leading edge of the ejecting sheets. Whichever is the registration edge of the underlying sheet should extend out from under the registration edge of the overlying sheet, so that even if the sheets are partially stuck together (as by static electricity), or relatively slippery, the underlying sheet will hit the registration edge first, to insure registration, since the overlying sheet registration is assured by the positive top registration drive 95 or 86 acting directly thereon. That is, in all cases, the underlying sheet should hit the registration edge wall before the top sheet. Therefore, for "uphill" stacking as in compiler 90, the exiting underlying sheet 18 lead edge should be slightly behind the overlying sheet 20 lead edge, so that the underlying sheet 18 trail edge at exit will extend beyond the overlying sheet 20 trail edge, so that in the "uphill" compiler tray 92, the underlying sheet 18 will register against wall **92*a* before the overlying sheet 20**. If, of course, the sheets are being inverted before stacking, the desired sheet edge output relationship would be reversed.

As noted above, FIG. 7 illustrates a dual mode system in which an additional gate 25 can be provided to gate downstream-moving sheets into the diverter chute 30, so as to alternatively use chute 30 as a normal output sheet inverter as well as functioning as described above with diverter gate 24 for non-inversion time delay of that or other sheets. The gate 24 will be moved down for feeding sheets out of the chute 30 in both modes. As shown, a separate upstream entrance chute 33 is desirably provided to help gate 25 deflect sheets into chute 30 from the upstream direction. A known mylar or other flexible flap one-way gate 35 may also be provided to insure that sheets exiting chute 30 can only exit via entrance 32, but sheets can freely enter chute 33 via entrance 33 by simply pushing flap gate 35 aside.

Figure 8:
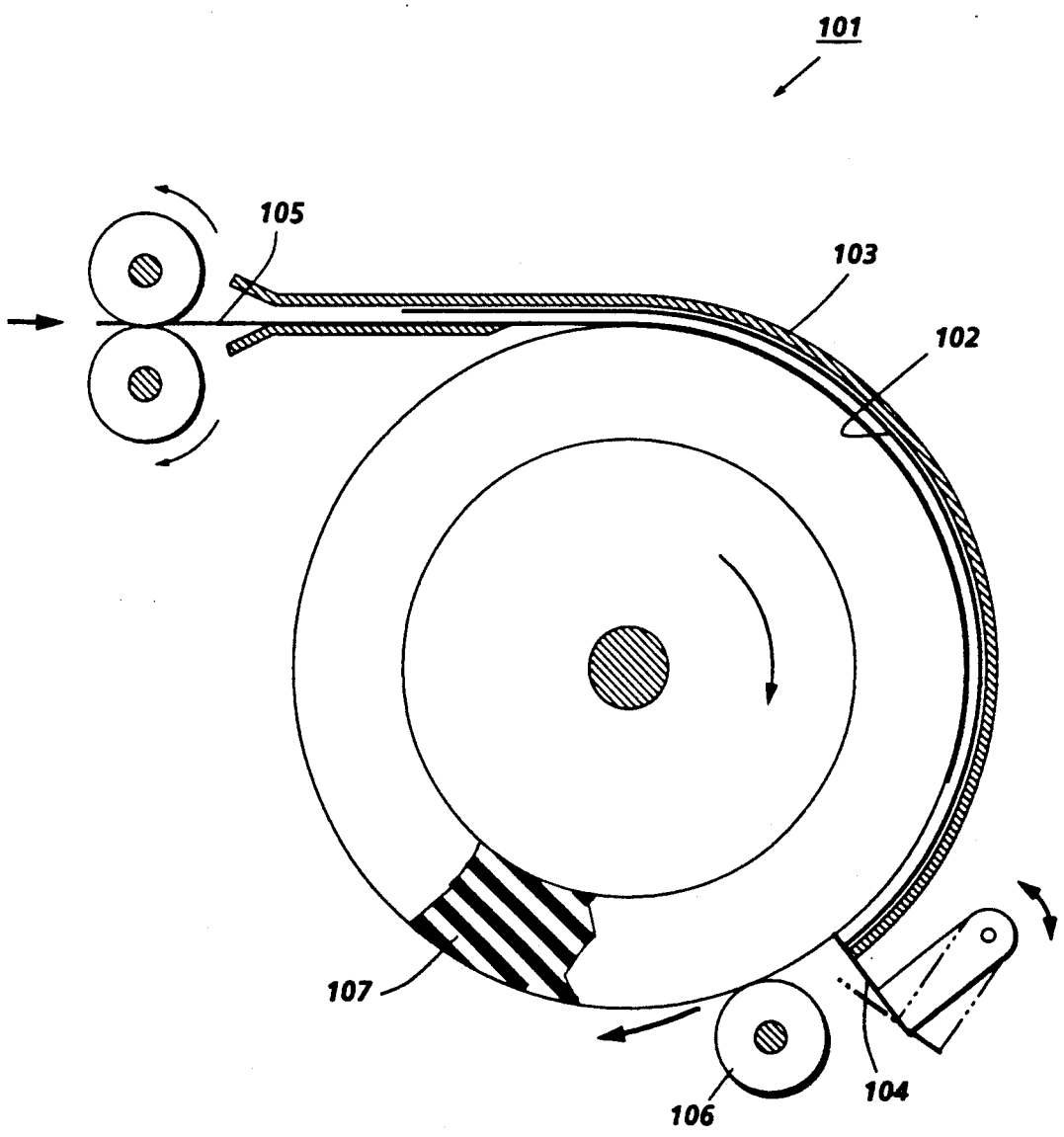
PRIOR ART FIG. 8
FIG. 8, labeled "prior art", illustrates an understanding of a prior art Eastman Kodak Co. product system, discussed above and below.

As noted above, the FIG. 8 "prior art" drawing illustrates a present understanding of a reported prior art Eastman Kodak copier system 101 for also delaying sheet output between precollated sets being finished. As understood, the first sheet 102 is fed around a large diameter compliant (rubber?) driven roller 107, under a closely partially surrounding baffle 103, until that first sheet 102 is is stopped temporarily by a gate 104. Then the next or second sheet 105 is fed in through that same path under the stationary first sheet 102 until it also reaches gate 104, etc.. Then gate 104 opens and all sheets 102, 105, etc. are fed on to a compiler (not shown) by the nip between that large roller 107 and another set of rollers 106. As understood, this system 101 does not provide a direct or positive drive of the first sheet 102, (then separated from drive roller 107 by the second sheet 105) during initial ejection of the two sheets from gate 104, and depends on inter-sheet friction between these sheets to overcome the friction between sheet 102 and baffle 103, which is presumably substantially increased by the baffle 103 curvature for stiff sheets which resist bending to that curvature. It is also believed that this Kodak system is quite limited in the range of paper sizes it can handle.

The present system maintains positive, non-slip, feed rollers nip engagement of all sheets at all times. Furthermore, the present system does not at any time require two sheets to be simultaneously in an arcuate path (confined by a curved baffle or the like), much less attempting to feed one sheet relative to the other, and then together, therein.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a reproduction apparatus for producing a sequential stream of precollated outputted printed copy sheets into a sheet output path with a limited space and time therebetween, and for compiling with edge registration and finishing said stream of output sheets into plural collated finished sets on line as subsequent said copy sheets are being printed and outputted by said sheet output path of said reproduction apparatus, by outputting said stream of copy sheets in said sheet output path downstream into a compiler tray for repeatedly sequentially stacking said copy sheets into collated printed sets, the improvement comprising:

a reversible exit sheet feeder upstream of said compiler tray for normally feeding copy sheets downstream to said compiler tray;

said reversible exit sheet feeder being selectably intermittently reversed to reverse the feeding of a first copy sheet therein upstream in coordination with the operation of said compiler tray on preceding copy sheets;

a sheet diverter chute path upstream of said exit sheet feeder, branching off from said sheet output path;

a diverter gate actuated to divert said first copy sheet out of said sheet output path into said diverter chute when that first copy sheet is reverse fed upstream by said reversible exit sheet feeder;

said diverter chute having another reversible sheet feeder therein for first feeding said first sheet into said diverter chute and then reversing to feed said first sheet out of said diverter chute in coordination with the passage past said diverter chute of a next subsequent second copy sheet, so that both said first and second copy sheets are fed downstream to said exit sheet feeder together;

said exit sheet feeder then being operated to feed both said first and second sheets together downstream to said compiler tray, with a substantial increase in said time between said first copy sheet and said preceding copy sheets being operated on in said compiler tray.

2. The reproduction apparatus for producing a sequential stream of precollated outputted printed copy sheets of claim 1, wherein said output path is substantially planar and said diverter gate is maintained out of said planar sheet output path whenever a sheet is moving downstream in said output path past said diverter gate, and wherein said diverter gate is actuated into said output path for said deflecting of said first sheet into said diverter chute in the reverse upstream movement of said first sheet, and not for said second sheet.

3. The reproduction apparatus for producing a sequential stream of precollated outputted printed copy sheets of claim 1, wherein said first sheet is underlying said second sheet as they are so fed to said compiler tray, and wherein said sheet feeder in said diverter chute is operated so that said first sheet being fed underlying into said compiler tray leads said overlying second sheet at the edges of said first and second sheets which are being edge registered in said compiler tray.

4. The reproduction apparatus for producing a sequential stream of precollated outputted printed copy sheets of claim 1, wherein said first sheet is underlying said second sheet as they are so fed to said compiler tray, and wherein said sheet feeder in said diverter chute is operated so that whichever is the registration edge of the underlying sheet extends out from under the corresponding edge of the overlying sheet as both sheets are fed downstream by said exit sheet feeder.

5. The reproduction apparatus for producing a sequential stream of precollated outputted printed copy sheets of claim 1, wherein said diverter chute selectably functions as a sheet inverter for said copy sheets in said output path.

6. The reproduction apparatus for producing a sequential stream of precollated outputted printed copy sheets of claim 2, wherein said first sheet is underlying said second sheet as they are so fed to said compiler tray, and wherein said sheet feeder in said diverter chute is operated so that said first sheet being fed underlying into said compiler tray leads said overlying second sheet at the edges of said first and second sheets which are being edge registered in said compiler tray.

7. The reproduction apparatus for producing a sequential stream of precollated outputted printed copy sheets of claim 5, wherein a second, differently actuated, diverter gate is provided for diverting said copy sheets into said diverter chute for inversion.

8. The reproduction apparatus for producing a sequential stream of precollated outputted printed copy sheets of claim 7, wherein an additional upstream entrance is provided for said diverter chute adjacent said second diverter gate.

* * * * *